United States Patent [19]

Paniri et al.

[11] 4,002,820

[45] Jan. 11, 1977

[54] POWER CABLE HAVING AN EXTENSIBLE GROUND CHECK CONDUCTOR

[75] Inventors: Zvi Paniri, Scarborough; Walter Shakotko, Toronto, both of Canada

[73] Assignee: Canada Wire and Cable Limited, Toronto, Canada

[22] Filed: Apr. 16, 1975

[21] Appl. No.: 568,529

[30] Foreign Application Priority Data

May 3, 1974 Canada ..... 198848

[52] U.S. Cl. ..... 174/115; 174/106 SC; 174/116

[51] Int. Cl.[2] ..... H01B 9/00

[58] Field of Search ..... 174/69, 106 SC, 115, 174/116, 114 R, 128 R, 130, 131 A, 120 SC

[56] References Cited

UNITED STATES PATENTS

| | | | |
|---|---|---|---|
| 1,654,508 | 12/1927 | Boggs | 174/131 A |
| 2,234,068 | 3/1941 | Wiseman | 174/106 SC |
| 2,450,429 | 10/1948 | Henning | 174/131 A |
| 2,609,653 | 9/1952 | Peterson | 174/128 R |
| 3,404,369 | 10/1968 | Grove | 174/114 R |
| 3,699,238 | 10/1972 | Hansen | 174/115 |
| 3,793,476 | 2/1974 | Misiura | 174/120 SC |

FOREIGN PATENTS OR APPLICATIONS

| | | | |
|---|---|---|---|
| 104,401 | 3/1917 | United Kingdom | 174/69 |
| 828,101 | 3/1958 | United Kingdom | 174/120 SC |

*Primary Examiner*—E. A. Goldberg
*Attorney, Agent, or Firm*—Fleit & Jacobson

[57] ABSTRACT

A power cable comprising three insulated power conductors helically stranded together, at least two grounding conductors located in the outer interstices between the power conductors and an extensible ground check conductor also located in the interstices between the power conductors or at the center. The ground check conductor includes a plurality of metallic wire strands helically wound together in a short lay in the same direction of lay, and extensible non-metallic materials separating the metallic wire strands for substantially eliminating direct friction between the groups of metallic wire strands during flexing and twisting of the cable.

19 Claims, 6 Drawing Figures

POWER CABLE HAVING AN EXTENSIBLE GROUND CHECK CONDUCTOR

This invention relates to power cables and more particularly to a power cable having an extensible ground check conductor for use in mining operations.

Certain mining equipments are fed with portable three-phase A.C. power distribution cables comprising generally three helically stranded insulated power conductors and at least two grounding conductors located in the outer interstices formed by the power conductors. It is well known that such cables are subjected to a high degree of abuse due to constant handling, reeling and unreeling. Such cables are often run over by the equipment, hit by stones from the mine blast, dragged over rock and trampled under foot.

Some of these mining equipments require monitoring of the grounding of the equipment and are therefore provided with a ground check conductor known as a "pilot" conductor. The pilot conductor is incorporated in the core of the cable and insulated from the grounding conductors and cable shields in order to serve its purpose in insuring safety of operating personnel in the mine against ground faults.

Traditionally, the pilot conductor constituted a weak spot in the cable system, mainly due to the fact that the conventional design of the pilot conductor incorporated plural groups of strands cabled together to form the conductor. Through the course of handling, individual wires suffered breakage due to friction of interlayer strands, and to elongation beyond sustainable limits.

It is therefore an object of the present invention to provide a power cable for use in mining operations which incorporates a ground check conductor which is much more extensible than the conventional ground check conductors.

The ground check conductor, in accordance with the invention, comprises a plurality of metallic wire strands helically wound in a short lay in the same direction and extensible non-metallic materials separating the various metallic wire strands so as to substantially eliminate friction between the strands and also to render the ground check conductor more elastic. To render the ground check conductor even more flexible, the lay of the individual wires of each strand may be in the same direction of lay as the lay of the strands themselves.

The extensible non-metallic material may be nylon cords such as nylon tire cord, elastomeric insulation or similar extensible materials. In a preferred embodiment of the invention, the ground check conductor consists of a first central nylon cord around which the metallic wire strands are wound in the same direction of lay and additional nylon cords placed between each metallic wire strand and, obviously, also wound in the same direction as the metallic wire strands.

The extensible non-metallic material may also be an extruded elastomeric material, such as polypropylene, synthetic or natural rubber, Hypalon (trade mark designating a rubbery material obtained by chlorination and sulfonation of polyethylene), rubber or any other elastomeric material. Extruded insulations over the individual strands are also included.

The typical lay of the individual strands is in the range of 0.15 to 0.5 inch so as to allow significant extension of the ground check conductor without breakage.

The ground check conductor may be surrounded with any conventional tape and suitable insulation material. The insulation may be further protected by a covering placed thereover.

The power cable into which the above ground check conductor is incorporated may take various forms although they are generally round cables consisting, as mentioned previously, of three power conductors and of at least two grounding conductors located in the outer interstices formed by the power conductors. In order to obtain balanced induced voltages in the grounding conductors, the ground check conductor may be placed at the center of the cable (inner interstice of the power cables) and three grounding conductors placed symmetrically in the interstices between the power conductors. However, when balanced induced voltages are not required, two grounding conductors only are provided and the ground check conductor is placed in one of the outer interstices between the power conductors.

The power conductors are normally covered with metallic shields such as copper and normally cabled together with the ground conductors, the pilot conductor and the suitable fillers to form a round core. However, due to the high degree of abuse to which the cables of the above type are subjected, the metallic shields often break, resulting in failures of the cable.

It is therefore another object of the present invention to provide a cable using semi-conducting material as a shield and which, in addition, does not have any fillers.

In a first embodiment, each insulated power conductor and grounding conductor is covered with a semi-conducting insulation forming a unitary insulated conductor having a cross-sectional area in the shape of a sector equivalent to a portion of a circle, and the ground check conductor is placed at the center of the cable.

Each power conductor is covered with an elastomeric insulation and the semi-conducting insulation is bonded to the elastomeric insulation. The elastomeric insulation may consist of ethylene-propylene rubber, natural rubber or butyl rubber, and the semi-conducting insulation made of the same material mixed with conducting material such as carbon black in known manner.

The grounding conductors are normally located symmetrically one between each power conductor for attaining balanced induced voltage in the grounding conductors.

In a second embodiment of the invention, the power and grounding conductors are helically wound around and supported by a cradle made of semi-conducting elastomeric material, and the ground check conductor is placed at the center of the cradle.

The power conductors are covered with a semi-conducting elastomeric material. The cradle, the power conductors and the grounding conductors are covered with a filler made of a semi-conducting elastomeric material to form a round core and also shield the power cable.

In both embodiments, the core of the cable formed by the power and grounding conductors themselves or the filler over the power and grounding conductors is shielded with a semi-conducting binder tape in contact with the semi-conducting insulation extruded over the power and grounding conductors. The core may be reinforced by means of a braid made of nylon tire cords or other suitable materials. Finally, an outer jacket of neoprene or other similar covering material such as Hypalon is extruded over the core.

The invention will now be disclosed, by way of example, with reference to preferred embodiments thereof illustrated in the accompanying drawings in which:

FIG. 1 illustrates a power cable incorporating a ground check conductor in accordance with the invention;

FIGS. 2 and 2*a* illustrate an enlarged section view of the ground check conductor of FIG. 1;

Figure 1:
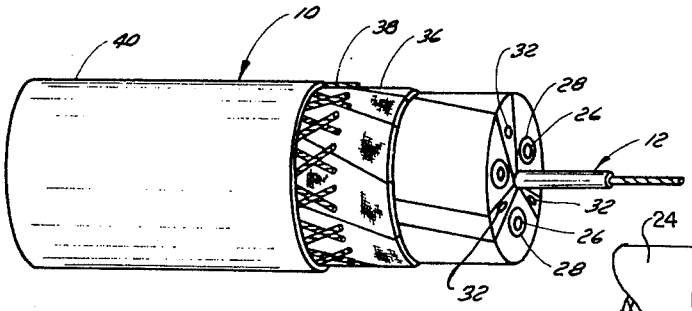
Figure 2A:
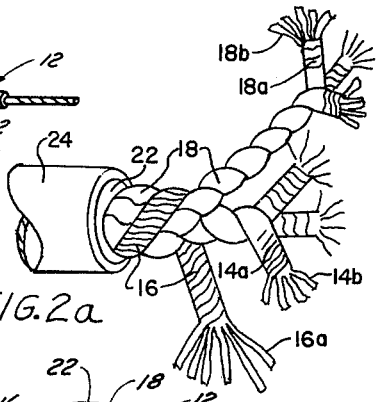
Figure 2:
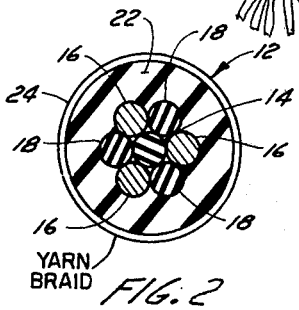

Referring to FIG. 1 of the drawings, there is shown a cable 10 embodying a ground check conductor 12 in accordance with the invention. Such ground check conductor is located at the center of the cable and, as illustrated more clearly in FIGS. 2 and 2*a*, comprises a central nylon cord 14 of the type known in the trade as a nylon tire cord around which are wound, in the same direction of lay, three metallic wire strands 16 each separated by additional nylon cords 18. Each nylon cord is made up of three nylon strands 14*a* or 18*a*, each including plural nylon monofilaments 14*b* or 18*b*. Each wire strand is made up of seven wires 16*a* twisted together in known manner although a larger or lower number of wires may be used. The typical lay of the individual metallic wire strands is in the range of 0.15 to 0.5 inch so as to allow significant extension of the ground check conductor without breakage. In order to still improve extension of the ground check conductor, the individual wires of the strands may also be wound in the same direction of lay as the wire or nylon strands.

Figure 3:
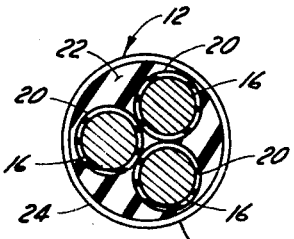
FIG. 3 illustrates an enlarged section view of another ground check conductor.

In the above embodiment of the invention, nylon is used as an extensible non-metallic material between the metallic wire strands so as to substantially eliminate friction between the metallic strands during flexing and twisting of the cable, thus rendering the cable more flexible. It is to be understood that other extensible non-metallic materials are envisaged. Such materials include extruded fillers, such as polypropylene, synthetic or natural rubber, Hypalon, ethylene propylene rubber or any other elastomeric material. As illustrated in FIG. 3, the elastomeric material 20 may even be extruded directly onto the individual wire strands 6.

Suitable insulation material 22 (such as ethylene propylene rubber) is extruded over the core and may be protected by a suitable covering 24 such as yarn braid, treated with lacquer or wax.

Figure 4:
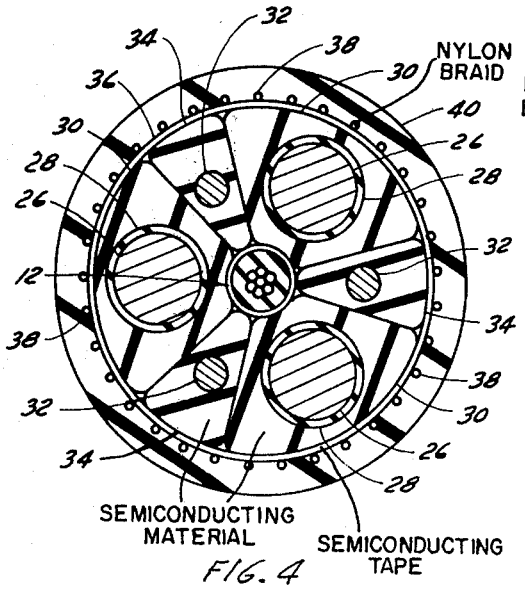
FIG. 4 illustrates an enlarged section view of the cable of FIG. 1.

Referring now to FIGS. 1 and 4, there is shown, by way of example, a cable into which the above disclosed ground check conductor is incorporated although the above ground check conductor may obviously be used in other types of power cables. The cable is a 2KV shuttle car cable including three power conductors 26 each made up of a plurality of strands of metallic wires covered with a layer of elastomeric insulation 28, such as ethylene-propylene rubber, natural rubber or butyl rubber. Each power conductor is covered with a semi-conducting insulation 30 forming a unitary insulated conductor having a cross-sectional area in the shape of a sector equivalent to a portion of a circle. The semi-conducting insulation is made of the same elastomeric insulation as the layer 28 but contains a predetermined amount of carbon black to render the insulation semi-conducting and so constitute a shield for the cable in known manner. The semi-conducting insulation 30 is extruded onto the insulated conductor 26 and bonded to the layer of elastomeric insulation 28 covering such conductor.

Three grounding conductors 32 each made up of a plurality of strands of metallic wires are inserted one between each power conductor. The grounding conductors are covered with semi-conducting elastomeric insulation 34, similar to the insulation 30 covering the power conductors, which is extruded over the grounding conductor. The semi-conducting covering 34 applied over each grounding conductor also has a cross section in the shape of a sector equivalent to a portion of a circle and completely fills the space between the power conductors so as to form a core which does not require any filler.

The cable illustrated in FIGS. 1 and 4 of the drawings has 90° shaped power conductors and 30° shaped grounding conductors. However, it is to be understood that this is due to the relative size of the power conductors with respect to the grounding conductors and also to the minimum amount of insulation permissible over such conductors. The relative cross sectional area of the elastomeric insulation will vary with the voltage rating and size of the cable.

A binder tape 36 is applied over the core of the cable and such binder tape is semi-conducting so as to shield the cable. The binder tape is covered with an open nylon braid 38 for reinforcing the cable. An outside jacket 40 of extra heavy duty neoprene or equivalent covering material is extruded over the whole assembly. The use of a semi-conducting binder tape in contact with the semi-conducting insulation 30 and 34 supplements the shielding over the power and ground conductors and eliminates the need of copper shields which, as mentioned previously, often break during handling, reeling and unreeling of the power cable. In addition, no filler is necessary.

The outside diameter of the above disclosed 2KV power cable is 1.485 inch. The power conductors 26 are No. 4 AWG and covered with a 0.06 inch elastomeric insulation 28. The grounding conductors are No. 11 AWG whereas the ground check conductor is No. 18 AWG. The minimum semi-conducting insulation wall thickness is 0.04 inch. It is to be understood, however, that the dimentional and electrical characteristics given above will vary with the voltage rating and size of the cable.

Figure 5:
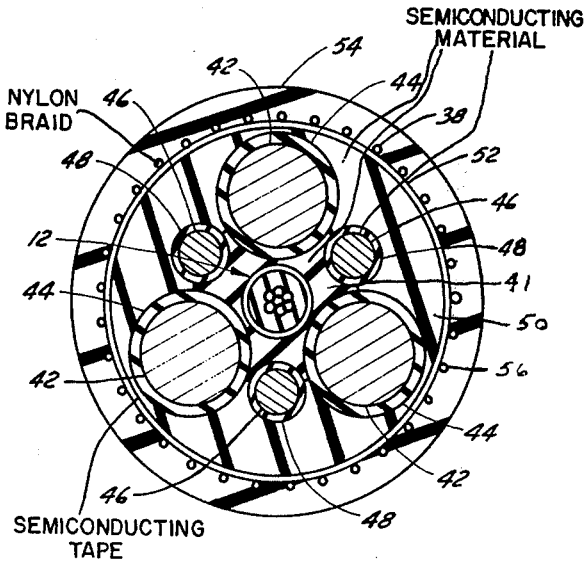
FIG. 5 illustrates an enlarged section view of another power cable incorporating a ground check conductor in accordance with the invention.

FIG. 5 illustrates a section view of a round shuttle car cable of the cradle core type incorporating a ground check conductor in accordance with the invention. The cable includes a cradle 41 at the center of which is inserted the ground check conductor 12 which is of the same type as the one illustrated in FIG. 2. The cradle 41 supports three helically wound power conductors 42 each made up of a plurality of strands of metallic wires covered with a layer of elastomeric insulation 44, such as ethylene-propylene rubber, natural rubber or butyl rubber. The cradle 41 is made of a semi-conducting insulating material consisting of the same elastomeric material as the insulation 44 but contains a predetermined amount of carbon black to render the insulation semi-conducting and so constitute a shield for the cable in known manner.

The cradle 41 also supports three grounding conductor 46 inserted one between each power conductor 42.

The grounding conductors are each made up of a plurality of strands of metallic wires and covered with a semi-conducting elastomeric layer 48 of the same material as the cradle. The assembly of the cradle, the power conductors, the grounding conductors and the ground check conductor is covered with a filler 50 made of semi-conducting insulating material of the same type as the cradle to form a round core. It will be understood that the cradle 41 and the filler 50 constitute a shield for the power cable. A semi-conducting binder tape 52, such as nylon tape incorporating carbon black is wound over the core in good contact with semi-conducting insulation 50 and an outer jacket 54 of neoprene or similar covering material is extruded over the whole assembly. The binder tape may be covered with an open nylon braid 56 for reinforcing the cable.

The outside diameter of the above disclosed shuttle car cable is 1.570 inch. The power conductors 42 are No. 2 AWG covered with a 0.07 inch elastomeric insulation 44. The grounding conductors are No. 9 AWG whereas the ground check conductor is No. 22 AWG. It is to be understood the the dimentional and electrical characteristics given above will vary with the voltage rating and the size of the cable.

The above disclosed ground check conductor has been subjected to flexing endurance test. Other constructions of ground check conductors were evaluated in the same test which involved repeated cycles of reverse twists and bends until complete breakage of individual wires. Results confirmed the superiority of the ground check conductor in accordance with the invention as compared to the conventional constructions.

Although the invention has been disclosed with reference to preferred embodiments thereof, it is to be understood that various modifications may be made thereto without departing from the scope of the present invention which is to be limited by the following claims only.

What is claimed is:

1. A power cable comprising three insulated power conductors helically stranded together, at least two grounding conductors located in the interstices between the power conductors and an extensible ground check conductor also located in the interstices between the power conductors, said ground check conductor including:

a. a plurality of metallic wire strands helically wound together in a short lay and in the same direction of lay; and b. extensible non-metallic material separating said metallic wire strands for substantially eliminating direct friction between the metallic wire strands during flexing and twisting of the cable.

2. A power cable as defined in claim 1, wherein said extensible non-metallic material consists of a first central nylon cord around which the metallic wire strands are wound, and an additional nylon cord placed between each metallic wire strand and wound in the same direction as the metallic wire strands.

3. A power cable as defined in claim 2, wherein said nylon cords are made of several strands, each including plural nylon monofilaments.

4. A power cable as defined in claim 1, wherein said extensible non-metallic material is an extruded elastomeric material.

5. A power cable as defined in claim 4, wherein said elastomeric material is selected from the group consisting of polypropylene, synthetic rubber, natural rubber, polyethylene, and ethylene-propylene rubber.

6. A power cable as defined in claim 4 wherein said elastomeric material is extruded over the individual metallic wire strands.

7. A power cable as defined in claim 1, wherein the lay of the individual metallic wire strands is in the range of 0.15 to 0.5 inch so as to allow significant extension of the ground check conductor without breakage.

8. A power cable as defined in claim 7, wherein each wire strand is made of a plurality of individual wires and wherein the lay of the individual wires of the strands is in the same direction as the lay of the metallic wire strands for additional enhancement of the flexibility of the ground check conductor.

9. A power cable as defined in claim 1, wherein the ground check conductor is surrounded with suitable insulation material, and wherein a covering is placed over the insulation material.

10. A power cable as defined in claim 1, wherein each insulated power conductor and each grounding conductor is covered with a semi-conducting elastomeric insulation forming a unitary insulated conductor having a cross-sectional area in the shape of a sector equivalent to a portion of a circle, said semi-conducting insulation acting as a shield for the cable and wherein said ground check conductor is located in the center of the cable.

11. A power cable defined in claim 10, wherein the power conductors are covered with elastomeric insulation and wherein said elastomeric insulation and the semi-conducting elastomeric insulation are bonded together.

12. A power cable as defined in claim 10, wherein the grounding conductors are located symmetrically one between each power conductor for obtaining balanced induced voltage in the grounding conductors.

13. A power cable as defined in claim 10, further comprising a semi-conducting binding tape covering the power and grounding conductors and in contact with the semi-conducting elastomeric insulation over the power and grounding conductors for further shielding the power cable.

14. A power cable as defined in claim 13, further comprising a nylon cord wound over the binding tape for reinforcing the power cable.

15. A power cable as defined in claim 14, further comprising an outer jacket extruded over the binding tape and the nylon cord.

16. A power cable as defined in claim 1, wherein said power and grounding conductors are helically wound around and supported by a cradle made of semi-conducting elastomeric material and wherein the ground check conductor is placed at the centre of the cradle.

17. A power cable as defined in claim 16, wherein the power conductors are covered with elastomeric insulating material, wherein the grounding conductors are covered with a semi-conducting elastomeric material, and wherein the cradle, the power conductors and the grounding conductors are covered with a filler made of a semi-conducting elastomeric material to form a round core and also shield the power cable.

18. A power cable as defined in claim 17, further comprising a semi-conducting binding tape covering the filler of semi-conducting elastomeric material for further shielding the power cable.

19. A power cable as defined in claim 18, further comprising an outer jacket extruded over the binding tape.

* * * * *